US006539675B1

(12) United States Patent
Gile

(10) Patent No.: US 6,539,675 B1
(45) Date of Patent: Apr. 1, 2003

(54) TWO-PIECE VENTED CORNICE DEVICE

(75) Inventor: Dennis Gile, Salt Lake City, UT (US)

(73) Assignee: Elite Exteriors, Inc., Salt Lake City, UT (US)

( * ) Notice: Subject to any disclaimer, the term of this patent is extended or adjusted under 35 U.S.C. 154(b) by 0 days.

(21) Appl. No.: 09/592,162

(22) Filed: Jun. 12, 2000

(51) Int. Cl.[7] ..... E04B 7/00; E04D 13/00; E04D 3/40

(52) U.S. Cl. ..... 52/96; 52/11; 52/94; 52/95; 52/288.1; 52/58; 52/60; 52/97; 52/302.1; 454/260; 454/365

(58) Field of Search ..... 52/96, 11, 94, 52/573.1, 287.1, 82, 95, 288.1, 58, 60, 97, 302.1; 454/260, 365

(56) References Cited

U.S. PATENT DOCUMENTS

| | | | | | |
|---|---|---|---|---|---|
| 1,085,886 | A | | 2/1914 | Wagner | |
| 2,676,554 | A | | 4/1954 | Wenger | |
| 2,896,559 | A | | 7/1959 | Stephens | |
| 5,170,597 | A | | 12/1992 | Stearns | 52/58 |
| 5,292,281 | A | | 3/1994 | Butler | 454/260 |
| 5,426,901 | A | * | 6/1995 | Indracek | 52/288.1 |
| 5,560,158 | A | | 10/1996 | Norton | 52/95 |
| 5,564,233 | A | | 10/1996 | Norton | 52/60 |
| 5,586,414 | A | | 12/1996 | Tawzer | 52/57 |
| 5,729,933 | A | | 3/1998 | Strength | 52/96 |
| 5,735,084 | A | * | 4/1998 | Zaccagni et al. | 52/11 |

* cited by examiner

*Primary Examiner*—Jose V. Chen
*Assistant Examiner*—Chi Q Nguyen
(74) *Attorney, Agent, or Firm*—Workman, Nydegger & Seeley

(57) ABSTRACT

A cornice device for building structures including a crown member and a connector member. The crown member has a first end configured to attach to the roof portion of the building structure and a second end. The crown member may include an optional fascia board and an optional roof nailer member attached to the fascia board. The connector member comprises a first leg configured to cooperate with the second end of the crown member. The second leg of the connector member is configured to couple to the outer wall of the building structure. The crown member and the connector member are configured to flex during installation to accommodate for various framing variances. The cornice device also includes means for discharging water from the cornice device which is spaced apart the outer wall of the building structure so as to keep the water discharged from and off the cornice device from damaging the outer wall. In one embodiment, the means for discharging water from the cornice device comprises a water trough and a plurality of apertures formed in the connector member, the crown member, or both. The apertures are configured to allow water to pass therethrough and also act as a means for ventilating a building structure. The apertures are substantially hidden from view. The means for discharging water from the cornice device may also comprise a drip lip which is configured to prevent water discharged off the cornice device from staining, discoloring, or damaging the outer wall of the structure. In one embodiment, the drip lip is formed by the second end of the crown member and the first leg of the connector member.

40 Claims, 5 Drawing Sheets

TWO-PIECE VENTED CORNICE DEVICE

BACKGROUND OF THE INVENTION

1. The Field of the Invention

The present invention generally relates to decorative details on a building structure, and, more specifically, to a cornice device having a combined soffit and crown detail.

2. The Prior State of the Art

Dwelling construction has a long and diverse architectural history. Each building structure, such as a residential home, building, stadium, arena or other building must not only provide a cover for the building and those individuals that remain therein, but must also resist large roof loads such as those from high wind, rain, snow and ice. Therefore, the roofs and outer walls of each building structure must prevent infiltration of these numerous weather conditions.

A typical roof type is that incorporated in a wood-frame dwelling. When the roof span is less than about 30 feet, the roof surface, typically a composition of shingles or tile placed on sheathing or plywood may be supported on rafters, which run from the peak of the roof to its eaves. When roof structures exceed about 30 feet, however, roof trusses are used instead of rafters, and include additional support furnished by longitudinal members, known as purloins, that span the trusses. Many, industrial buildings use a similar construction, however, the trusses, purloins, and roof surface are generally fabricated from steel or prestressed concrete or other load-bearing materials.

No matter the type of roof construction used, each roof design must accommodate for adequate attic or interior roofing ventilation. Satisfactory attic ventilation is necessary for many reasons. For example, attic ventilation not only removes heat and moisture from attic spaces in hot weather, but also removes attic condensation in cold weather to prolong building structure and roofing material life, while preserving the viability of the attic insulation.

In some situations to obtain the adequate ventilation, the rafters or roof trusses of many building structures extend beyond the outer walls of the dwelling or building to form vented eaves. Accordingly, the soffit, or horizontal underside of the eave, is typically fitted with vents of varying designs to allow air to pass into the attic from the outside. As such, hot, moist air inside the attic may exit from roof vents positioned higher than the vents in the eaves, while cooler, dryer air may enter the attic through the vents. In this manner, a continuously circulating flow of air passes through the attic space to maintain the desired temperature and humidity. The use of vented eaves is not limited to those building structures that include overhanging rafters and roof trusses. Building structures having no overhanging roof structure still require ventilation and protection from the weather elements.

Generally, the traditional extension of roof rafters or roof trusses over the outer wall was adopted as one method to provide the necessary attic ventilation. Additionally, the inclusion of overhanging rafters and roof trusses prevents water passing from the roof and traversing along the surface of the sidewalls of the building structure. Typically, the eave or overhang has a length of about twelve to about twenty-four inches. Local or regional building codes, however, may vary these dimensions. The inclusion of the overhang results in a significant increase in construction costs due to more complicated eave structures and a larger roof surface area that extends beyond the outer walls.

In many cases, the eave or overhang between the outer walls of the building structure and the ends of the roof rafters or trusses is covered with a cornice structure. The cornice structure commonly is fabricated from a number of different elements that combine to prevent weather conditions, such as wind, rain, snow, and the like, from entering into the attic space of the building, while allowing ventilation of the attic space. In one configuration, the cornice structure includes a fascia panel that covers a member that is attached to the ends of the roof rafters or trusses, typically termed a subfascia. A separate soffit commonly extends between the outer wall and the bottom portion of the fascia. Similar components are also used for those building structures without overhanging rafters or trusses, thereby allowing ventilation of the attic space while preventing infiltration of weather conditions within the building structure.

The cornice structure may be fabricated from wood. This, however, requires installing several component parts, such as the fascia panel, soffit, and interface between the outer wall and the soffit. Each component must be sized and shaped so that an accurate fit is achieved between adjacent components, the roof, and the outer walls. Unfortunately, wood decorative structures, though pleasing to the eye, are expensive and time consuming to install.

One alternative to wood is aluminum. Traditionally, aluminum sheets, having a standard width of approximately fifteen inches (15") and termed a "gutter coil", are formed into various decorative structures, such as the cornice structure, that may be placed between the outer walls and the roof. Each section includes venting holes that are traditionally visible from below the decorative structure. Though aluminum cornice structures are somewhat easier to install than wood, aluminum structures still have a number of significant disadvantages.

One significant shortcoming of currently available cornice structures, including those having integral soffit and fascia structures, is that they are not capable of discharging water that may creep within or under the shingles, such as when ice dams form. In such a case, water that falls below the lower edge of the shingles or other roofing structure passes back by capillary action upwardly beneath the shingles or roofing, thereby causing water damage to the roof, fascia board, soffit, and other parts of the building structure. In addition, in many of the currently available cornice structures, water becomes trapped behind the cornice structure itself and cannot escape through the cornice. As a result, the water tries to move downward and ends up moving along the interior of the outside wall. Consequently, water that is trapped by the cornice structure causes water damage. The water damage may be that which is typical of trapped moisture such as mildew and wood decay. In the more severe cases, the water may go to the interior surface of the wall and cause damage to the interior surface as well as enter the interior of the building. Repairing water damage to a building structure can be expensive and time consuming.

Another significant problem with many conventional cornice structures is that they allow water to drip along the edges of the cornice structure such that the water drips onto or runs down the surface of the outer walls of the building structure. Such water usually contains a large amount of debris, minerals, or other material that coats the surfaces of the shingles or roofing. As a result, as the water travels down the outer walls of the building, the debris, minerals, or other material, is then deposited on the outer surface of the outer walls creating an unsightly stain. Additionally, as the water traverses the surface of the outer wall, water may seep through the,outer surface of the outer walls, such as in the case when stucco is applied to the outer surface of the outer wall, or through the mortar of a brick house, thereby causing water damage to the building structure.

In addition to the above, many conventional cornice structures maintain and have ventilation holes located on the soffit structure. Though they maintain the necessary ventilation of the attic space, there is a desire to hide or conceal the holes so that a typical aluminum cornice structure does not look like aluminum but looks like the more expensive wood trim.

As such, there is a need for a decorative structure which is simple to install, reduces fabrication costs of the decorative designs, prevents water damage or discoloring of the building structure, particularly the outer walls, while minimizing the visual effects of requiring venting.

OBJECTS AND SUMMARY OF THE INVENTION

It is an object of the present invention to provide a cornice device that is easy to install between an outer wall and a roof of a building structure.

It is another object of the present invention to provide a cornice device that prevents water from staining or discoloring the surface of the outer wall of a building structure.

Another object of the present invention is to provide a cornice device that allows ventilation of the interior attic space, while concealing the method of ventilation.

Another object of the present invention is to provide a cornice device that is configured to allow any water that may get behind the cornice device to escape, thereby reducing and even preventing water damage to the building structure.

Yet another object of the present invention is to provide a cornice device that allows for the discharge of water that may creep between a roofing material and the cornice device in such a way that the water is prevented from passing along the outside surface of the outer wall and damaging the outer wall.

Still yet another object of the present invention is to provide a method of installing a cornice device that is simple, and allows for accommodation of various construction deviations in the outer wall and roof.

To achieve the foregoing objects, and in accordance with the invention as embodied and broadly described herein a cornice device for building structures is provided that includes a crown member and a connector member. The crown member has a first end and a second end. The first end of the crown member is configured to attach to the roof portion of the building structure. In one embodiment, the second end of the crown member has a locking groove formed therein. The crown member may include an optional fascia board. In another embodiment, the crown member may also include a roof nailer member attached to the said fascia board.

The connector member comprises a first leg and a second leg. The first leg of the connector member is configured to cooperate with the second end of the crown member, while the second leg of the connector member is configured to couple to the outer wall of the building structure. The crown member and the connector member are configured to flex during installation to accommodate for various framing variances.

The cornice device also includes means for discharging water from the cornice device. The means for discharging water from the cornice device is spaced apart the said outer wall of the building structure so as to keep said discharged water from contacting the outer wall, thereby, avoiding staining, discoloring, or damaging the outer wall due to the discharged water running down or contacting the surface of the outer wall. In one embodiment, the means for discharging water from the cornice device comprises a water trough, formed by the interior surfaces of the crown member and the connector member, and a plurality of apertures formed in either the connector member, the crown member, or both. The plurality of apertures are configured to allow water to pass therethrough. The plurality of apertures also act as a means for ventilating a building structure, and are substantially hidden from view. The means for discharging water from the cornice device may further comprise a drip lip which is configured to prevent water discharged from the cornice device from discoloring or damaging the outer wall of the structure. In one embodiment the drip lip is formed by the second end of the crown member and the first leg of the connector member.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

BRIEF DESCRIPTION OF THE DRAWINGS

In order to show that the manner in which the above recited and other advantages and objects of the invention are obtained, a more particular description of the invention briefly described above will be rendered by reference to specific embodiments thereof that are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

The present invention relates to cornice devices and systems which may be used to hide or decorate the overhang between a roof structure and an outer wall of a building structure. The cornice device is configured to be easily installed against both the roof structure and the outer wall, while allowing ventilation of the attic space of the building structure. Furthermore, the cornice device and systems of the present invention are capable of conforming to framing imperfections in the roof framing, while concealing the manner by which the attic space is ventilated. Additionally, the cornice device and systems of the present invention are adapted to discharge water that may creep into the interior of the roof structure, so that the water is prevented from becoming trapped behind the cornice device and damaging the building structure. The innovative design of the cornice device also prevents water from passing down the surface of the outer wall by directing any water that traverses the exterior surface of the cornice device away from the outer wall, thereby preventing water from contacting the outer wall and causing staining, discoloring, or damaging the outer wall. As such, the cornice device and systems of the present invention discharges any water accumulating within the interior of the roof structure in a controlled manner, while allowing ventilation of the attic space of the roof structure. The configuration of the cornice device and systems of the present invention substantially simulates the visual appearance of typical wood cornice devices while using less expensive and more easily installed structures.

Generally, the cornice device and systems shall be described hereinafter with reference to a residential house. It will be appreciated, however, that various other types of building structures may utilize the beneficial principals of the present invention. As such, the discussion of applicability of the present invention to a residential house should not be considered as limiting the application of the general principles of the invention to other building structures, such as commercial, industrial, or other building structures.

Figure 1:
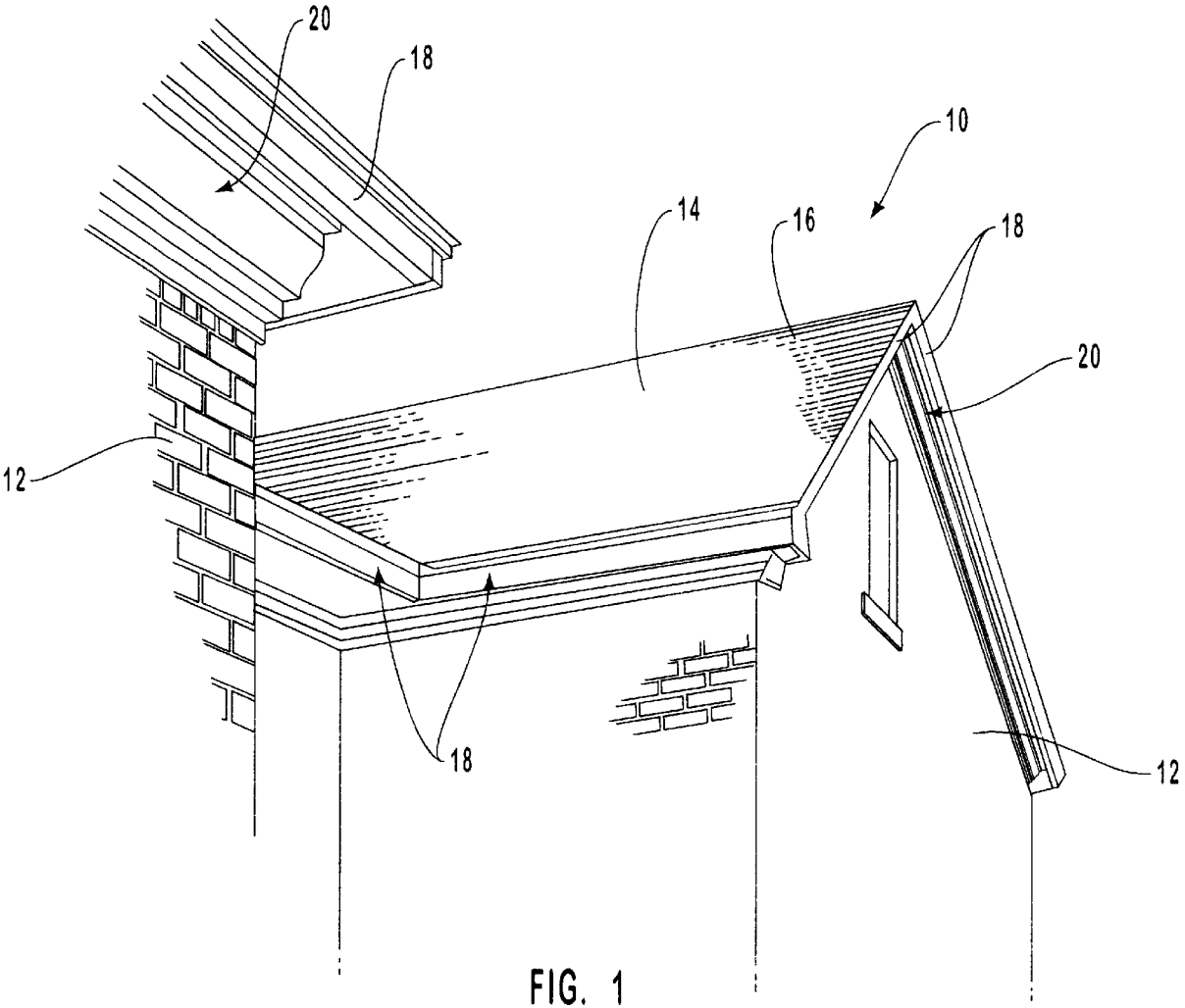
FIG. 1 is a perspective view of one embodiment of a building structure with one embodiment of the cornice device of the present invention.

FIG. 1 depicts a building structure 10 having a number of outer walls 12 which support a roof 14. Outer walls 12 may be fabricated or constructed having an outer skin of a protective siding, such as aluminum or a vinyl siding, or may include a stucco material, brick, masonry, shingles, and other similar weather protection materials. Similarly, roof 14 is covered with various types of roofing material 16, such as asphalt, shingles, wood shakes, concrete tile, slate, or the like, which prevents infiltration of various weather elements, such as snow, rain, wind, or the like into building structure 10. As depicted, attached to the ends of roof 14 is a fascia board 18 that protects the ends of the roof trusses (not shown) while adding a decorative feature to building structure 10. Extending between fascia board 18 and outer wall 12 is cornice device 20.

Figure 2:
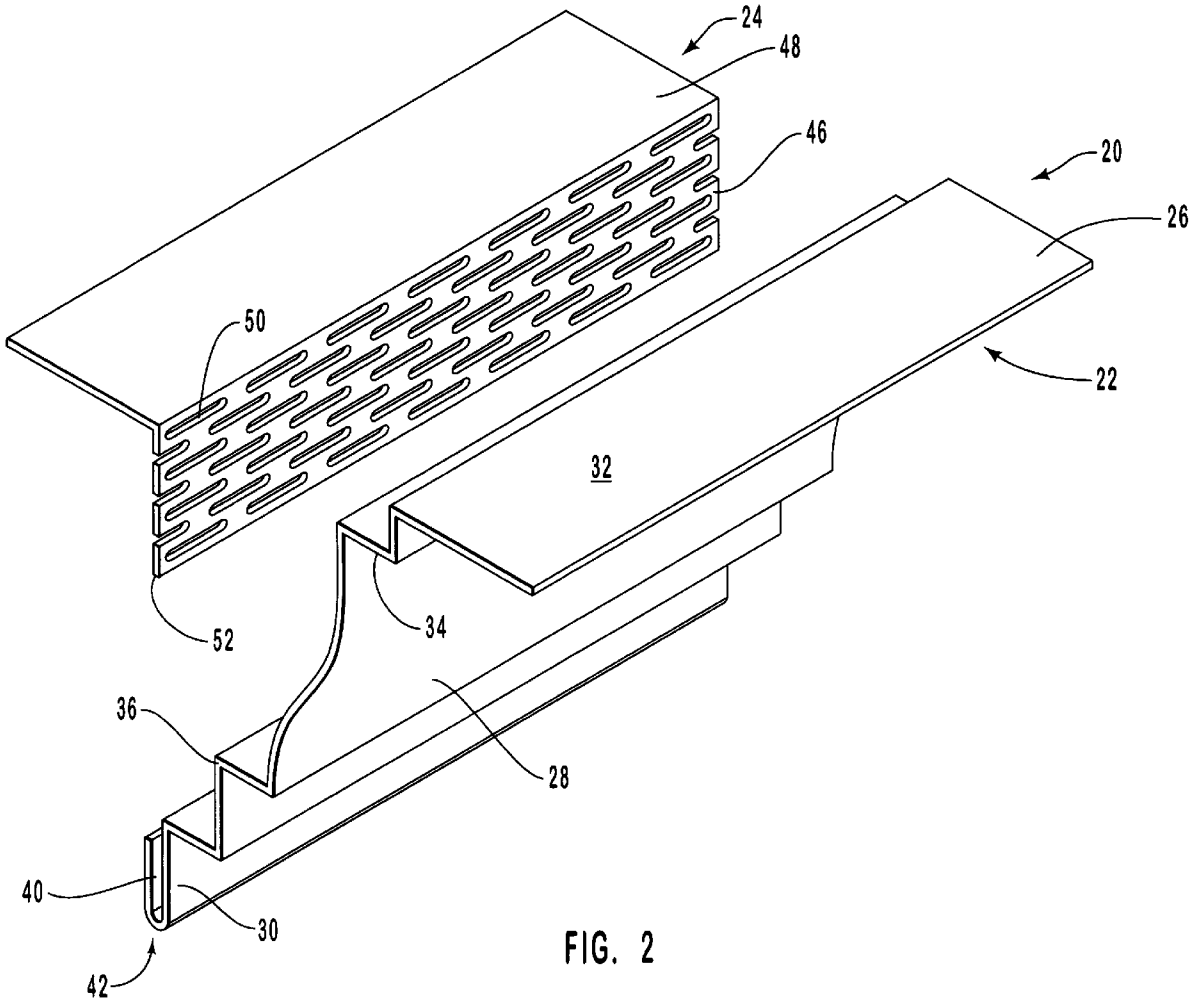
FIG. 2 is an exploded perspective view of the cornice device of FIG. 1.

Referring now to FIG. 2, in one embodiment of the present invention, cornice device 20 includes a crown member 22 and a connector member 24. Crown member 22 has a first end 26, an intermediate portion 28, and a second end 30. Proximate to first end 26 is a soffit portion 32. In one embodiment of crown member 22, soffit portion 32 has a generally planar configuration. Soffit portion 32 and first end 26 are configured to cooperate with fascia board 18 (FIG. 1) to allow cornice device 20 to attach to building structure 10, as shown in FIG. 1. As such, soffit portion 32 may have various other configurations that are known by one skilled in the art, such as, by way of example and not limitation, curvilinear, stepped, angular, or other configurations, so long as soffit portion 32 and first end 26 of crown member 22 are capable of attaching to roof portion 14 of building structure 10.

In one embodiment, crown member 22 also includes intermediate portion 28 that has a curved configuration similar to that of a typical crown molding or frieze commonly attached to building structure 10. It will be appreciated by one skilled in the art that intermediate portion 28 may have various other curvatures and configurations than that depicted in FIG. 2 that are capable of achieving the decorative effect desirable from cornice device 20.

The transition between intermediate portion 28 and soffit portion 32 of crown member 22 is accomplished, in one embodiment illustrated in FIG. 2, by way of an optional step portion 34. Although step portion 34 has a stepped configuration, it will be appreciated that the transition between intermediate portion 28 and soffit portion 32 may have various other configurations such as, by way of example and not limitation, planar, angular, curved, and the like. Further, step portion 34 may be eliminated all together without effecting the function of crown member 22, as will be illustrated hereinafter in one or more of the various illustrative embodiments of the present invention.

In one embodiment of crown member 22, second end 30 is configured to form one possible configuration of a drip lip 42 and a locking groove 40. As illustrated in FIG. 2, in one embodiment, drip lip 42 has a generally U-shaped configuration such that water traversing the surface of crown member 22 passes to the distal end of drip lip 42 to be discharged therefrom. It will be appreciated that drip lip 42 may have various configurations other than that shown in FIG. 2. In general, drip lip 42 forms the portion of cornice device 20 that is closest to the ground. A drip lip, such as drip lip 42, by way of example and not limitation, provides a way for rain and/or water discharged from cornice device 20 to drip off cornice device 20 rather than running down outer wall 12. Water off of cornice device 20 may be dirty, contain materials from the roof or minerals which can stain or discolor the outer wall 12. In some cases, the water may even damage the material on the outer wall such as stucco, brick, stone, or the like.

Figure 3B:
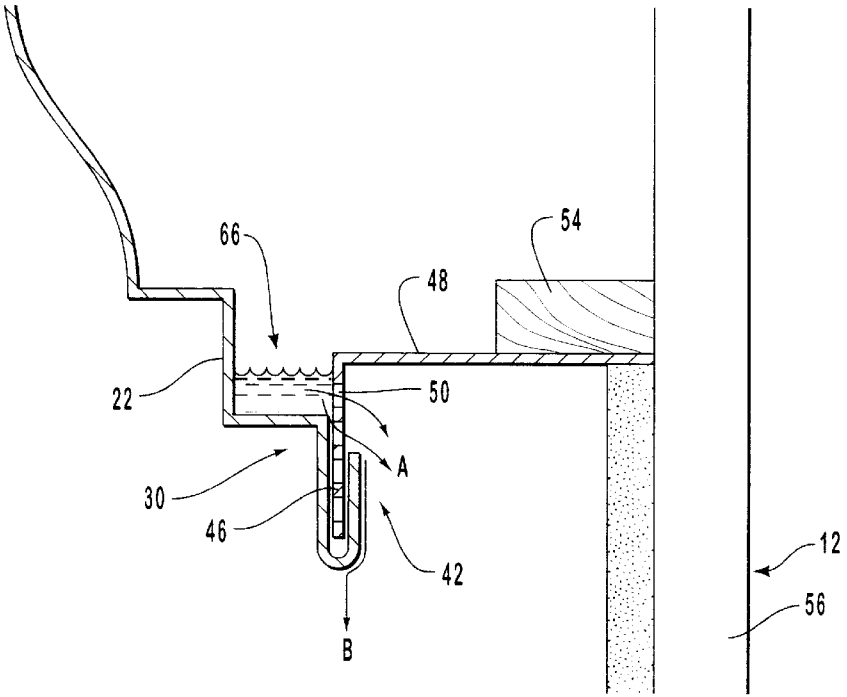
FIG. 3B is a cross-sectional side view of a portion of the structure depicted in FIG. 3A.
Figure 3A:
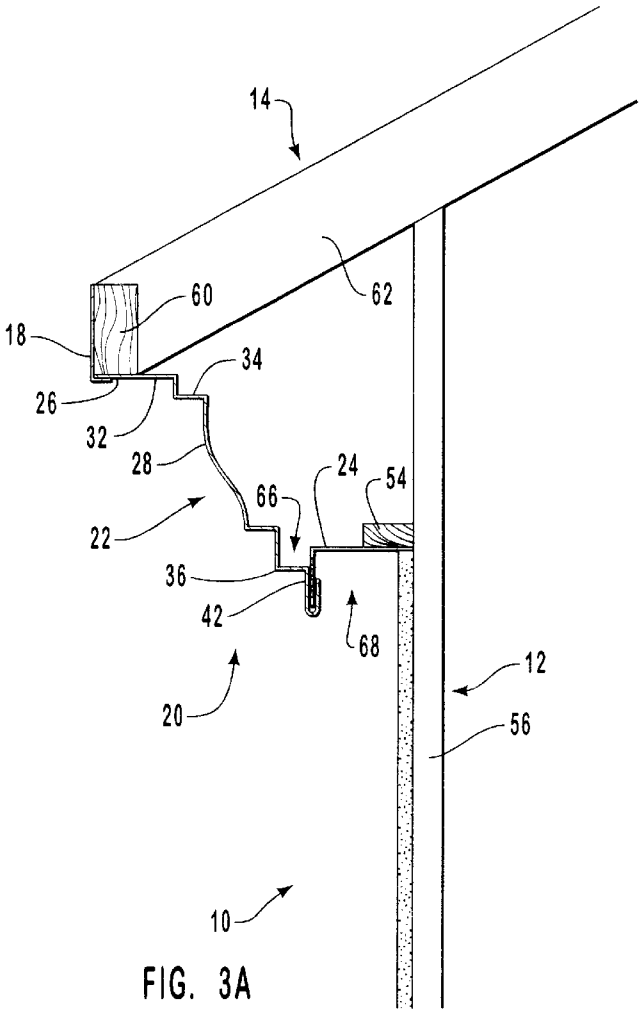
FIG. 3A is a cross-sectional side view of the cornice device of FIG. 1.

In one embodiment of cornice device 20 illustrated in FIG. 3A, drip lip 42 extends generally downwardly toward the ground or base of building structure 10 upon installation to building structure 10. As shown in this particular embodiment, drip lip 42 is substantially parallel to outer wall 12. It can be appreciated by one skilled in the art, however, that drip lip 42 may have at various other orientations relative to outer wall 12. The orientation of drip lip 42 is limited only by the requirement that the water discharged from drip lip 42 is not directed onto the surface of outer wall 12.

Referring again to FIG. 2, while drip lip 42 is depicted in this embodiment as being U-shaped it will be appreciated that drip lip 42 may have various other configurations as long as each configuration is capable of discharging water in a controlled manner such that the water does not run down the outside surface of outer wall 12. For example, in another configuration, drip lip 42 may have a V-shaped, square, triangular, ovular, or the like cross-sectional configuration. In yet another configuration, drip lip 42 may include a plurality of optional apertures or holes therethrough in the surface of drip lip 42 facing outside wall 12 of building 10.

In one embodiment of crown member 22 depicted in FIG. 2, locking groove 40 is formed by one embodiment of drip lip 42 proximate to second end 30 of crown member 22. In this embodiment, locking groove 40 has a generally, U-shaped configuration and is adapted to allow connector member 24 to attach to crown member 22, such as through a friction-fit or slip-fit connection. It will be appreciated by one skilled in the art that there are various other configurations of locking groove 40 that are applicable to allow attachment of crown member 22 to connector member 24. For example, locking groove 40 may be tapered, ovular, or some other configuration to allow a slip fit between connector member 24 and crown member 22. Further, it will also be appreciated that it is not necessary for drip lip 42 and locking groove 40 to be coincident. It is contemplated that drip lip 42 and locking groove 40 may occur at different places along crown member 22. Further, it is contemplated that drip lip 42 may even be formed in connector member 24 rather than crown member 22. The important characteristics of drip lip 42 and locking groove 40 are that they be configured to cooperate with connector member 24.

In yet another configuration, crown member 22 may include a plurality of locking grooves 40 that cooperate with complementary portions formed in connector member 24. In addition, it will be appreciated that second end 30 of crown member 22 may itself act as a drip lip. Further, it will be appreciated by one skilled in the art, that various other ways of interconnecting second end 30 of crown member 22 may be utilized that do not include locking groove 40. For example, in another possible configuration, crown member 22 is devoid of locking groove 40, and instead crown member 22 is attached to connector member 24 by way of one or more conventional fasteners, such as screws, rivets, nuts and bolts, adhesives, and the like.

Similar to the transition between soffit portion 32 and intermediate portion 28, crown member 22 may also include an optional step portion 36 that forms the transition between intermediate portion 28 and second end 30. It will be appreciated that step portion 36 may be omitted or other configurations of step portion 36 may be used.

Generally, crown member 22 may be manufactured from various types of materials ranging from metals, plastics, or the like. In one embodiment crown member 22 may be manufactured from standard fifteen-inch (15") wide aluminum "gutter coils." Fifteen-inch (15") gutter coil is typically the maximum width of the standard widths of aluminum gutter coils that are traditionally manufactured and readily available. By using standard widths of material, the present invention is inexpensively manufactured, thereby reducing the cost associated with installation of the cornice device 20. Additionally, the use of standard widths of material reduces the lag time or delay between ordering and receiving the desired raw materials for manufacturing cornice device 20. It is contemplated, however, that cornice device 20 may be made out of various materials, such as metals including aluminum, copper, and steel, as well as fiber glass, vinyl, urethane, plastics, and the like, depending on the particular application and configuration. Further, it is also contemplated that in some instances, cornice device 20 may have various widths that require the use of gutter coils other than the standard widths.

As previously mentioned, cornice device 20 also includes connector member 24 that is configured to cooperate with second end 30 of crown member 22. In one embodiment, connector member 24, as depicted in FIGS. 2, 3A and 3B, has a generally L-shaped form comprising a first leg 46 and second leg 48. Though first leg 46 and second leg 48 are depicted in FIG. 2 as being substantially perpendicular to one another, it can be appreciated that first leg 46 and second leg 48 may be at different angular orientations relative to each other. It will also be appreciated that the configuration of connector member 24 may be varied without effecting the function thereof as long as first leg 46 is configured to cooperate with second end 30 of crown member 22 and second leg 48 can be attached to outer wall 12.

As illustrated in FIG. 2, in one embodiment of connector member 24, first leg 46 includes a plurality of ventilating apertures 50 that extend along the longitudinal length thereof. Ventilating apertures 50 allow air to pass into the attic (not shown) of building structure 10 (FIG. 1) to ventilate building structure 10 and maintain the desired temperature and humidity therein. Additionally, ventilating apertures 50 allow water that may get behind cornice device 20 or enter into the interior of building structure 10 to be discharged in a controlled manner.

As depicted in FIG. 2, in one embodiment of connector member 24, ventilating apertures 50 are substantially equally spaced along first leg 46. It will be appreciated that ventilating apertures 50 may be located in groups along first leg 46 or in various other arrangements other than those depicted in FIG. 2. Further, although ventilating apertures 50 are depicted as being generally oval shaped openings, various other configurations of ventilating apertures 50 may be used, such as square, elliptical, circular, trapezoidal, triangular, and the like or any combination thereof, without effecting the function thereof. Generally, ventilating apertures 50 should be of sufficient size to allow the water to draw freely out from the interior of building structure 10 through cornice device 20, while allowing a sufficient quantity of air to flow into building structure 10.

In one embodiment of connector member 24 illustrated in FIG. 2, first leg 46 has a distal end 52 that is adapted to be securely disposed within locking groove 40 of crown member 22. As depicted, in one embodiment, first leg 46 is generally planar such that it may be friction-fit or slip-fit within locking groove 40. Various other configurations of first leg 46 are acceptable as long as first leg 46 is capable of attaching to crown member 22, whether by way of locking groove 40 or by some other manner. In an alternative configuration, first leg 46 may include a flanged portion that increases the width of first leg 46 to form a tighter lock within locking groove 40. In yet another configuration, first leg 46 has at least one-protrusion extending from the surface thereof that interlocks with a complementary hole proximate to second end 30 of crown member 20. In another configuration, first leg 46 may be glued, bonded, or otherwise affixed within locking groove 40 or to another portion of crown member 20. Likewise, various traditional mechanical fasteners can be used to keep first leg 46 attached to second end 30 of crown member 22.

As depicted in FIGS. 2, 3A, and 3B, in one embodiment second leg 48 of connector member 24 also has a generally planar form. It will be appreciated that second leg 48 of connector member 24 could have various other configurations including curved, angular, and the like. As illustrated in FIGS. 3A and 3B, in one embodiment, second leg 48 is adapted to be affixed to outer wall 12 of building structure 10 by way of an optional framing block 54. Generally, second leg 48 is adapted to be attached to framing block 54 through conventional attaching methods, such as nails, screws, rivets, adhesives, and the like. Consequently, the configuration of second leg 48 may vary as necessary depending on the type of material covering or forming outer wall 12, such as brick, masonry, siding, wood shakes, or the like. In addition, the configuration of second leg 48 of connector member 24 may be modified depending on the particular method used to affix second leg 48 to outer wall 12. For example, second leg 48 may have fastener holes (not shown) formed therein to allow second leg 48 to be attached to framing block 54. Alternatively, second leg 48 may be devoid of fastener holes. In another configuration, second leg 48 may include one or more flanges that are adapted to attach to an interior wall of the building structure either proceeding, during, or subsequent to the installation of the materials covering or forming outer wall 12. In yet another embodiment, second leg 48 may include one or more flanges that are adapted to allow connector member 24 to be attached directly to outside wall 12 with or without the use of framing block 54.

As with crown member 22, connector member 24 may be manufactured from fifteen-inch (15") gutter coil. It will be appreciated that connector member 24 may, however, be made of other aluminum coils of varying widths without effecting the function thereof. Further, it is contemplated that various other materials of varying widths may be utilized to form connector member 24, such as other metals, including copper and steel, as well as vinyl, and plastics, or the like.

Referring now to FIGS. 3A and 3B, one embodiment of cornice device 20 is depicted attached to building structure 10. As shown in this embodiment, outer wall 12 has a stucco shell surrounding an interior wall 56, such as made from plywood, or the like. In this configuration, as shown in FIG. 3B, the combination of the interior surfaces of at least first leg 46 of connector member 24 and second end 30 of crown member 22 defines a water trough 66. Water trough 66 may be formed by various embodiments of second end 30 of crown member 22 cooperating with first leg 46 of connector member 24. Water trough 66 is adapted to collect any water that may seep or creep past fascia board 18 and cornice device 20 or through roof 14 behind cornice device 20.

First leg 46 of connector member 24 and second end 30 of crown member 22 are configured to cooperate so as to form water trough 66 configured such that water may collect within water trough 66, as illustrated in FIG. 3B, until it reaches a specific level sufficient to pass through ventilating apertures 50 in first leg 46 of connector member 24, as depicted by arrows A. The water exiting from ventilating apertures 50, in this embodiment, runs downwardly along the inside surface of drip lip 42 until it drops off the remote end of drip lip 42 to the ground, as generally shown by arrow B. Ventilating apertures 50, therefore, are sufficiently sized and configured to allow air and water to freely flow therethrough, which is of particular importance in drawing water through water trough 66.

In this way, any water that may seep or circumvent the exterior protection provided by roofing materials 16, fascia board 18, and cornice device 20 will be collected and released through cornice device 20, thereby substantially reducing or even preventing water from penetrating the outside wall 12 and from causing damage to outer wall 12 itself or the interior of building structure 10. Further, the water is discharged from, as well as runs-off of, cornice device 20 in a controlled manner thereby avoiding contacting outer wall 12 and the accompanying staining, discoloration, or damage of outer wall 12 by the dirt, minerals, and/or tar from the roof, or the like, contained in the water.

Ventilating apertures 50 are one embodiment of structure capable of performing the function of a means for ventilating a building structure. It will appreciated that various other structure or embodiment of ventilating apertures can perform the function of a means for ventilating a building structure. One advantage of the present invention is that ventilating apertures 50 are hidden from view.

Water trough 66, formed by at least first leg 46 of connector member 24 and second end 30 of crown member 22, drip lip 42, and ventilating apertures 50 are one example of structure capable of performing the function of means for discharging water from the cornice device. It will be appreciated by one skilled in the art, that there are various other configurations of means for discharging water from the cornice device. For example, in another configuration, the inside surface of drip lip 42 includes a plurality of ventilating apertures 50. Therefore, the water that is captured by water trough 66 exits the interior of cornice device 20 by passing through ventilating apertures 50 and through the ventilating apertures formed in drip lip 42. In this manner, the water exits from the interior of cornice device 20 and runs downwardly along the inside surface of drip lip 42 until it drops off the end of drip lip 42 to the ground. In another configuration of means for discharging water from cornice device 20, first leg 46 is securely retained within locking groove 40 without completely filling locking groove 40. In such a case, the water from water trough 66 fills any gap between locking groove 40 and first leg 46. Once the water attains a sufficiently high level within locking groove 40, the water exits through both apertures formed in locking groove 40 and from the open end of locking groove 40 to run downwardly along the inside surface of drip lip 42 and drop off the end of drip lip 42 to the ground.

According to another aspect of the present invention, in one embodiment as illustrated in FIG. 3A, drip lip 42 is configured to have a spaced apart relationship with outer wall 12 to form recess 68. Recess 68 creates a shadowed area between outer wall 12 and cornice device 20 that hides or prevents viewing of ventilating apertures 50 when viewed from below or substantially below cornice device 20. In this way, recess 68 provides a similar shadowed area to that achieved from traditional wood soffits, crowns, friezes, or the like, while maintaining separation between drip lip 42, water trough 66, and outer wall 12 to prevent the water from getting into outer wall 12 and to prevent water discharged from drip lip 42 from contacting outer wall 12. As a result, water damage or staining to outer wall 12 is minimized and even prevented.

As previously discussed, in one embodiment cornice device 20 is installed on building structure 10 by attaching second leg 48 of connector member 24 to outer wall 12 using framing block 54 and one or more fasteners. Upon attaching second leg 48 to framing block 54, first leg 46 is attached to second end 30 of crown member 22. Once crown member 22 and connector member 24 are attached together, first end 26 of soffit portion 32 is attached to fascia board 18 and a subfascia 60 of roof 14 using conventional attaching methods.

It will be appreciated by one skilled in the art that there are various other steps and methods by which cornice device 20 may be attached to building structure 10. For example, first end 26 of soffit portion 32 of crown member 22 may be attached to subfascia 60 before connector member 24 is attached to outer wall 12. In another method of the present invention, first end 26 of soffit portion 32 is connected to fascia 18 and subfascia 60 before crown member 22 is attached to connector member 24.

Figure 4:
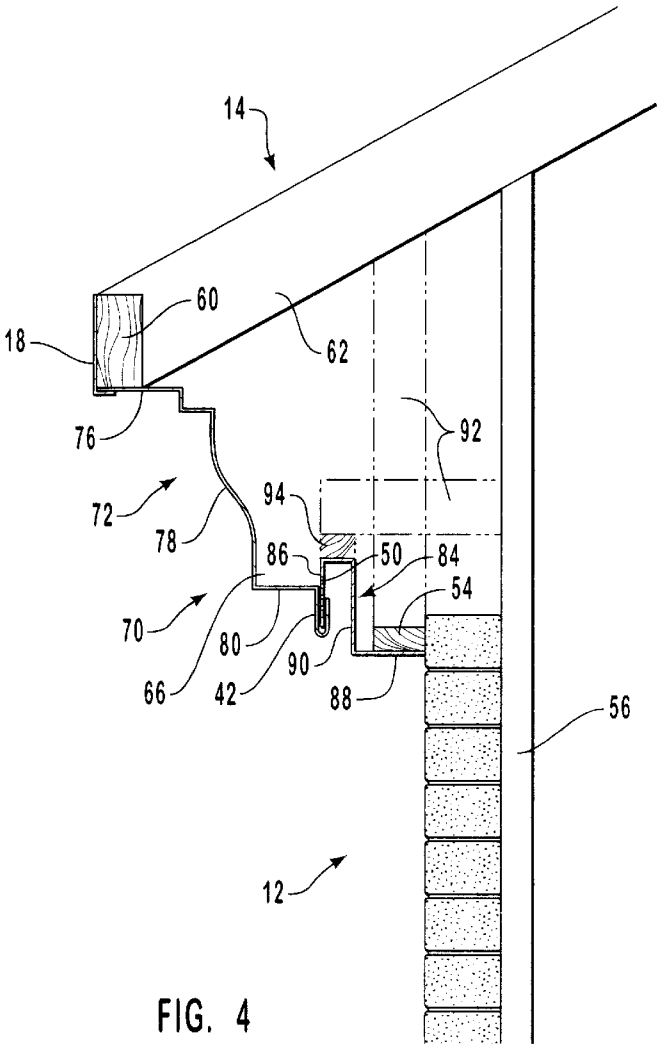
FIG. 4 is a cross-sectional side view of an alternate embodiment of the cornice device of the present invention.

An alternate embodiment of cornice device 70 is depicted in FIG. 4. The majority of the features previously discussed also apply to the second embodiment of cornice device 70. The features that are not effected are identified with the same reference numbers used in FIGS. 1–3B. FIG. 4 illustrates an alternate configuration of crown member 72 and connector member 84. As depicted in this embodiment, crown member 72 has a first end 76 and a second end 80 separated by an intermediate portion 78. In contrast to the embodiment of crown member 22 depicted in FIG. 3A, crown member 72 is devoid of optional transition portion between intermediate portion 78 and second end 80.

As depicted, in this embodiment, connector member 84 has a first leg 86 and a second leg 88 separated by an intermediate portion 90. In one embodiment of connector member 84, intermediate portion 90 has a generally L-shaped configuration that allows connector member 84 to flex during installation so that connector member 84 is capable of "floating" with framing variances of building structure 10 (i.e., connector member 84 may be flexed to accommodate for variations in the distance between roof 14 and outer walls 12). In other words, in one embodiment of connector member 84, first leg 86 and intermediate portion 90 form a generally U-shaped portion of connecting member 84. This configuration of connector member 84 allows cornice device 80 to be more easily installed between outer wall 12 and roof structure 14 than conventional structures, thereby reducing installation time, cost and the difficulty associated with locating cornice device 70 in place.

It can be appreciated by one skilled in the art that various other configurations of connector member 84 and cornice device 70 may be used to minimize the effects of framing variances on the installation time, cost, and difficulty of installation of cornice device 20. For example, connector member 84 may be configured with multiple intermediate portions 90 that provide additional flexibility to connector member 84. In yet another configuration, intermediate portion 90 may be eliminated from connector member 84 and a similar feature could be incorporated into crown member 72, such as by way of example, as part of second end 80 or intermediate portion 78 to even further increase the flexibility of crown member 72.

In still yet another configuration, both crown member 72 and connector member 84 are adapted to flex. It will be appreciated, that while intermediate portion 90 and first leg 86 of connector member 84 are depicted as being generally U-shaped, it is contemplated that various other configurations of intermediate portion 90 and first leg 86 could be used. By way of example and not limitation, connector portion 90 could connect first leg 86 and second leg 88 in various configurations including linearly or curvelinearly. What is important with connecting member 84 is that first leg 86 is configured to cooperate with second end 80 of crown member 72. This embodiment of connector member 84 is very effective in concealing ventilating apertures 50 and creating a shadow effect by spacing drip lip 42 away from outer wall 12. In addition, in this embodiment of connector member 84, intermediate portion 90 and second leg 88 also act as a decorative piece of the cornice device 70.

As depicted in FIG. 4, in one embodiment intermediate portion 90 may be optionally attached to outer wall 12 through framing members 92 and 94, shown by broken lines, to provide additional stability to cornice piece 80.

As illustrated in FIG. 4, second end 80 of crown member 78 cooperates with first leg 86 of connector member 84 to form water trough 66, which collects and discharges any water, which may get behind cornice device 70, out ventilating apertures 50.

Figure 5:
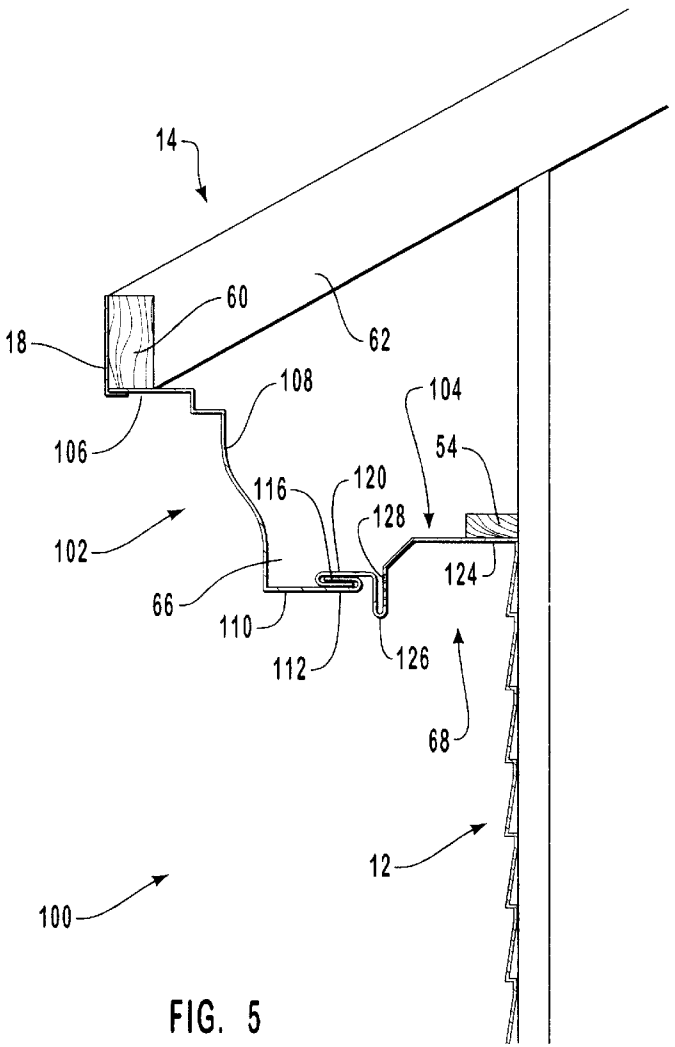
FIG. 5 is a cross-sectional side view of another alternate embodiment of the cornice device of the present invention.

Referring now to FIG. 5, another alternative embodiment of cornice device 100 is depicted. The majority of the features discussed with reference to cornice device 20 of FIG. 3A also apply to cornice device 100. As illustrated in FIG. 5, cornice device 100 includes a crown member 102 and a connector member 104. Crown member 102 has a first end 106 and a second end 110, separated by an intermediate portion 108. As with the embodiment of the crown member depicted in FIG. 4, on crown member 102 the optional transition portion between intermediate portion 108 and second end 110 has been eliminated. Second end 110 of crown member 102 includes an alternate configuration of locking groove 112 where locking groove 112 is substantially perpendicular to the angular orientation of outer wall 12. It will be appreciated, however, that locking groove 112 may have various other angular orientations with respect to outer wall 12 as long as it is configured to cooperate with connector member 104. It will also be appreciated by one skilled in the art that locking grooves 112 and 116 could be eliminated and second end 110 of crown member 102 may be attached to first leg 120 of connector member 104 by conventional fasteners and/or methods.

Connector member 104 includes a first leg 120 and a second leg 124. Formed in first leg 120 of connector member 104 is a complimentary locking groove 116 that in this embodiment allows connector member 104 to be attached to locking groove 112 of crown member 102. As such, the specific configuration of locking groove 116 may vary as necessary to cooperate with locking groove 112 in crown member 102.

In one embodiment of connector member 104, illustrated in FIG. 5, first leg 120 includes a drip lip 126 that functions similarly to drip lip 42 of FIG. 3A. In this embodiment, drip lip 126 extends substantially downwards toward the ground so that water traversing along the exterior surface of cornice device 100 and any water discharged from cornice device 100 may be discharged from the distal end of drip lip 126 without passing down or contacting outer wall 12.

As shown, drip lip 126 is spaced apart from outer wall 12 so as to have a recess 68, similar to that illustrated in FIG. 3A. Additionally, in one embodiment, drip lip 126 includes a plurality of ventilating apertures 128 which allows air to pass into the interior of building structure 10. Second end 110 of crown member 102 and first leg 120 of connector member 104 form water trough 66 which collects any water that is behind cornice device 100 and discharges it out ventilating apertures 128. The combination of water trough 66, drip lip 126, and ventilating apertures 128 is another example of structure capable of performing the function of means for discharging water from the cornice device. It will be appreciated that drip lip 126 and ventilating apertures 128 may have various other configurations as known by one skilled in the art to perform the desired function of means for discharging water from the cornice device.

In one embodiment of connector member 104 depicted in FIG. 5, a portion of first leg 120 of connector member 104 proximate to second leg 124 is angularly oriented. The angular orientation of a portion of first leg 120 enhances the ability of connector member 104, and therefore cornice device 100, to flex during installation. Flexing of connector member 104 allows cornice device 100 to accommodate framing variances in outer wall 12, as discussed previously. It can be appreciated, that various other configurations of first leg 120 of connector member 104 may be utilized and known by one skilled in the art.

Figure 6:
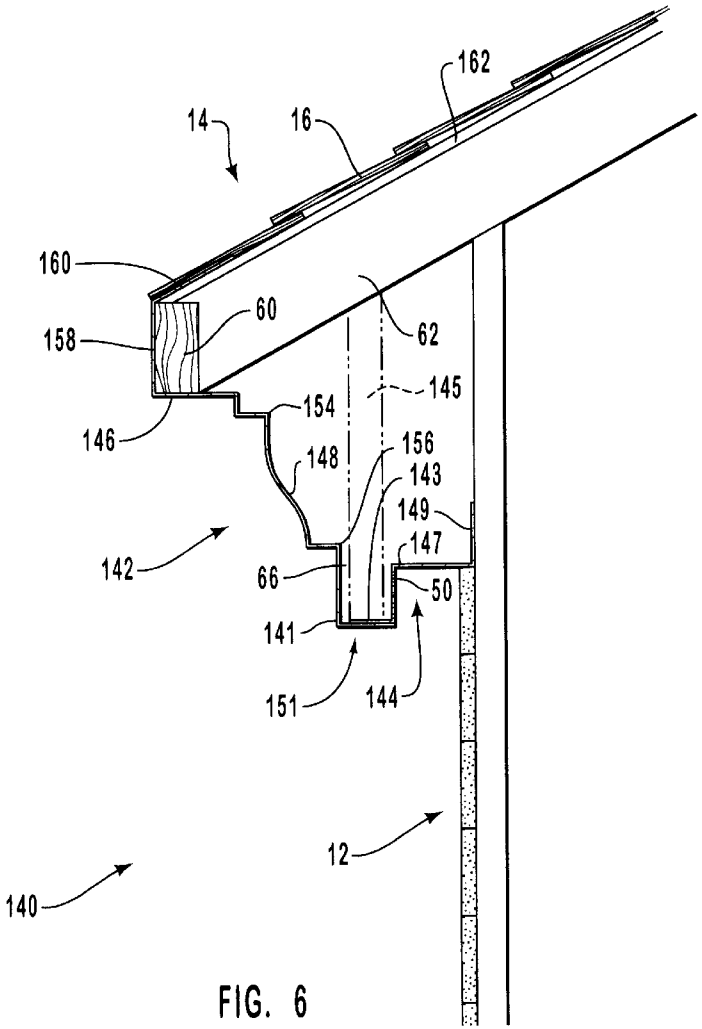
FIG. 6 is a cross-sectional side view of yet another alternate embodiment of the cornice device of the present invention.

FIG. 6 illustrates another embodiment of cornice device 140. The majority of the features discussed with respect to cornice device 20 of FIG. 3A also apply to cornice device 140 shown in FIG. 6. In one embodiment shown in FIG. 6, crown member 142 has a somewhat similar configuration as crown member 22 shown in FIG. 3A. In one embodiment of crown member 142, however, crown member 142 also includes fascia board 158 and an optional roof nailer member 160. In one embodiment of crown member 142, fascia board 158 is integrally formed with first end 146 of crown member 142.

Fascia board 158 surrounds subfascia 60 to give protection to subfascia 60 and roof truss 62 from various weather conditions, while adding a decorative accent to building structure 10. In one embodiment of crown member 142, connected to fascia board 158 is roof nailer member 160. It will be appreciated that roof nailer board 160 may be integrally formed with fascia board 158. Roof nailer member 160 is adapted to provide secure attachment of cornice device 140 to building structure 10. Roof nailer member 160, therefore, may include a plurality of optional holes (not shown) that are adapted to allow one or more fasteners, such as nails or screws, to attach roof nailer member 160 to roof 14. In an alternate embodiment, roof nailer member 160 may not include any holes, such that the fasteners may punch through roof nailer member 160. Various types of conventional fasters or methods of attaching roof nailer member 16 are known to those skilled in the art. For example, adhesives, rivets, clips, and the like may be used to attach roof nailer member 160 to the roof 14.

In one embodiment of crown member 142 illustrated in FIG. 6, crown member 142 extends from roof 14, substantially surrounds subfascia 60, and terminates in a fairly close proximity to outer wall 12, leaving a sufficient recess to allow installation of a connector member 144. It will be appreciated that crown member 142 could alternatively terminate further away from outer wall 12 as long as connector member 144 is similarly configured so as to cooperate with second end of crown member 142.

As illustrated, in this embodiment crown member 142 has a second end 141 in which a locking groove has been eliminated. Second end 141 of crown member 142 is configured for attachment to first leg 143 of connector member 144. In one embodiment, an optional wood firring board or framing strip 145 can be used to attach second end 141 of crown member 142 to first leg 143 of connector member 144. It will be appreciated that various other converting fasteners and methods of attaching second end 141 of crown member 142 to first leg 143 of connector member 144 may be utilized.

As illustrated, second end 141 of crown member 142 and first leg 143 of connector member 144 form water trough 66. First leg 143 of connector member 144 has ventilating apertures 50 formed therein to allow water to escape. In this embodiment of cornice device 140, first leg 143 of connector member 144 and second end 141 of crown member 142 form drip lip 151.

As shown in FIG. 6, in one embodiment of connector member 144, second leg 147 has a flange 149 formed thereon which allows connector member 144 to be directly mounted to outer wall 12 by conventional methods. One advantage of this embodiment of connector member 144 is that it simplifies installation and increase the strength of the attachment of connector member 144 to outer wall 12.

Figure 7:
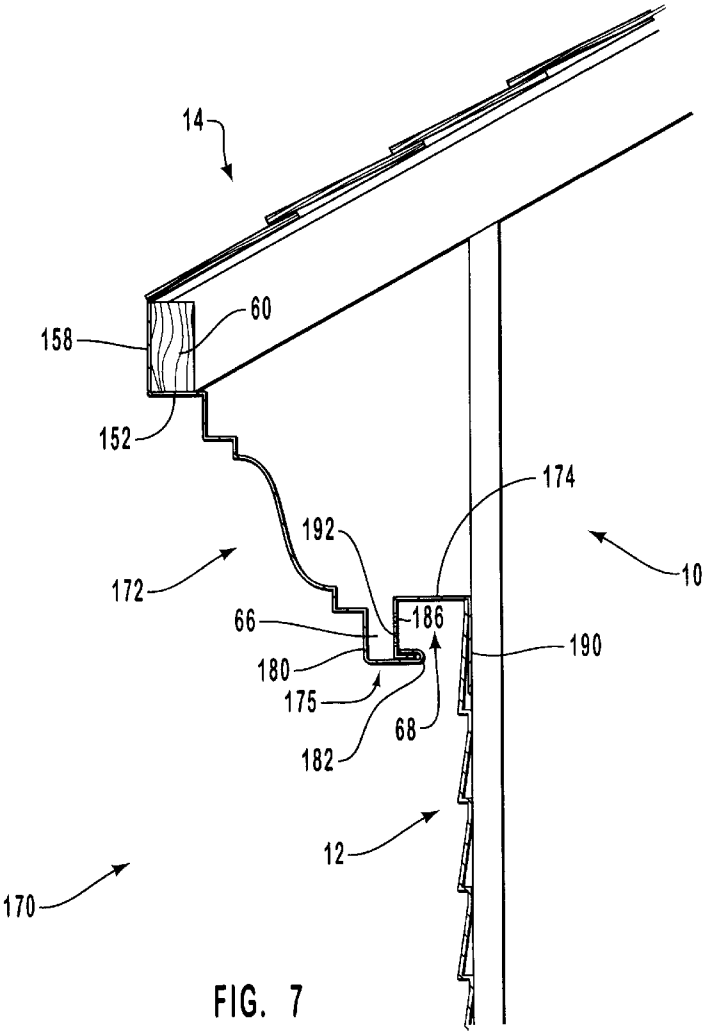
FIG. 7 is a cross-sectional side view of yet another alternate embodiment of the cornice device of the present invention.

FIG. 7 depicts another embodiment of cornice device 170. The majority of the 17 features of discussed with respect to cornice device 20 of FIG. 3A also apply to cornice device 170 shown in FIG. 7. In this configuration, a crown member 172 of cornice device 170 includes a locking groove 182 formed by a second end 180 of crown member 172. As shown, locking groove 182 is orientated substantially perpendicular to outer wall 12. It may be appreciated by one skilled in the art that locking groove 182 may be orientated at various other angular directions with respect to outer wall 12 of building structure, so long as locking groove 182 is capable cooperating with a connector member 174 and does not direct the water onto outer wall 12.

One embodiment of crown member 172 illustrated in FIG. 7 includes fascia board 158 that is attached to first end 152 of crown member 172. In one embodiment, first end 152 of crown member is integrally formed with fascia board 158.

In one embodiment of connector member 174 depicted in FIG. 7, connector member 174 includes a first leg 186 and a second leg 190. In this embodiment of connector member 174, second leg 190 has a generally L-shaped configuration to allow second leg 190 to be attached to outer wall 12 of building 10. Specifically, in the embodiment of connector member 174 illustrated in FIG. 7, such as where outer wall 12 is covered with siding, shingles, or the like, a portion of second leg 190 is located behind a portion of the siding, shingles, or the like. As such, it may be appreciated that depending on the particular covering forming part of outer wall 12, second leg 190 may more easily affect secure attachment of cornice device 170 to building 10. Further, while second leg 190 is depicted in FIG. 7 as being substantially L-shaped, it will be appreciated that various other configurations of second leg 190 may be used. By way of example, second leg 190 may be V-shaped or U-shaped. This embodiment of second leg 190 of connector member 174 allows vinyl, wood, masonite, or the like to be disposed directly against connector member 174, thereby eliminating a need for a separate piece of trim to complete the cornice device.

In one embodiment of connector member 174 illustrated in FIG. 7, first leg 186 of connector member 174 has a plurality of ventilating apertures 192 formed therein to allow air to come in as well as to discharge any water. In another embodiment, however, second leg 190 may include ventilating apertures 192. First leg 186 is configured to cooperate with locking groove 182 formed by second end 180 of crown member 172 to securely attach connector member 174 to crown member 172 and has ventilating apertures formed therein. Second end 180 of crown member 172 and first leg 186 of connector member 174 define water trough 66. Water trough 66 and ventilating apertures 192 are one embodiment structure capable of carrying out the function of a means for discharging water from the cornice device. In one embodiment of cornice device 170, second end 180 of crown member 172 and first leg 186 of connector member 174 act as a drip lip 175.

In the embodiment illustrated in FIG. 7, first end 180 of crown member 172 and connector member 174 cooperate together to form structure capable of acting as drip lip 175 to discharge water from the cornice structure in a controlled manner so as to keep the water off outer wall 12 so as to prevent staining or discoloring of outer wall 12. The structure that cooperates to form drip lip 175 also has a spaced away relationship with outside wall 12 and forms recess 68. The spaced apart relationship enhances the ability of cornice device to discharge water away from outer wall 12 as well as to provide the shadowing effect that looks like wood crown molding. The structure that acts as a drip lip is capable of performing the function of the means for discharging water from the cornice device.

The present invention may be embodied in other specific forms without departing from its spirit or essential characteristics. The described embodiments are to be considered in all respects only as illustrative and not restrictive. The scope of the invention is, here fore, indicated by the appended claims rather than by the foregoing description. All changes which come within the meaning and range of equivalency of the claims are to be embraced within their scope.

What is claimed and desired to be secured by United States Letters Patent is:

1. A cornice device for building structures having outer walls comprising:

(a) a crown member comprising a first end and a second end, said first end being configured to attach to a roof portion of the building structure, said crown member having a decorative multisurfaced configuration;

(b) a connector member comprising a first leg and a second leg, said first leg being configured to cooperate with said second end of said crown member remote from an outer wall of the building structure, said second leg being configured to attach to the outer wall, said second leg extending outwardly from the outer wall; and (c) means for discharging water from the cornice device, said means for discharging water from the cornice device being spaced apart from the outer wall of the building structure so as to prevent said discharged water from damaging or staining the outer wall.

2. A cornice device as recited in claim 1, wherein said second end of said crown member has a locking groove formed therein.

3. A cornice device as recited in claim 2, wherein said lock groove is generally parallel to said outer wall of said building structure.

4. A cornice device as recited in claim 2, wherein said lock groove is generally perpendicular to the outer wall.

5. A cornice device as recited in claim 1, wherein said means for discharging water from the cornice device comprises:

(a) a water trough formed by the interior surfaces of said crown member and said connector member; and (b) a plurality of apertures formed in at least one of said connector member and said crown member, said plurality of apertures being configured to allow water to pass therethrough.

6. A cornice device as recited in claim 5, wherein said plurality of apertures are formed in said connector member.

7. A cornice device as recited in claim 2, wherein said means for discharging water from the cornice device comprises a drip lip.

8. A cornice device as recited in claim 7, wherein said drip lip is oriented substantially downward.

9. A cornice device as recited in claim 7, wherein said locking groove and said drip lip are substantially coincident.

10. A cornice device as recited in claim 7, wherein said drip lip is generally U-shaped.

11. A cornice device as recited in claim 7, wherein said drip lip is formed in said connector member.

12. A cornice device as recited in claim 7, wherein said drip lip is formed by said second end of crown member and said first leg of said connector member.

13. A cornice device as recited in claim 1, further comprising means for ventilating a building structure.

14. A cornice device as recited in claim 13, wherein said means for ventilating a building structure comprises a plurality of apertures formed in one of said crown member and said connector member.

15. A cornice device as recited in claim 14, wherein said means for ventilating a building structure is substantially hidden from view.

16. A cornice device as recited in claim 8, wherein said drip lip is the portion of the cornice device closest to the ground.

17. A cornice device for building structures comprising:

(a) a crown member having a first end and a second end, said first end being configured to attach to the roof portion of the building structure, said second end of said crown member having a drip lip formed therein, said crown member having a decorative multisurfaced configuration; and (b) a connector member comprising a first leg and a second leg, said first leg being configured to cooperate with said second end of said crown member remote from an outer wall of the building structure, said second leg being configured to attach to the outer wall, said second leg extending outwardly from the outer wall such that said first leg is spaced apart from the outer wall, said first leg having at least one aperture formed therein so as to allow water to pass therethrough so as to be discharged from the cornice device without damaging or staining the outer wall.

18. A corner device as recited in claim 17, wherein said second end of said crown member has a locking groove formed therein.

19. A cornice device as recited in claim 17, wherein said first leg of said connector member is configured to cooperate with said locking groove.

20. A cornice device as recited in claim 17, wherein said drip lip has a spaced apart relationship with the outer wall of the building structure.

21. A cornice device as recited in claim 17, wherein said drip lip is generally U-shaped.

22. A cornice device as recited in claim 17, wherein said connector member is capable of flexing to allow the cornice device to conform to the space between the roof portion of the building structure and the outer wall of the building structure.

23. A cornice device as recited in claim 17, wherein said locking groove is orientated generally horizontally.

24. A cornice device as recited in claim 17, wherein said first leg of said connector member comprises a complementary locking groove configured to engage with said locking groove of said crown member.

25. A cornice device as recited in claim 24, wherein said complementary locking groove in said connector member is generally parallel to the outer wall of the building.

26. A cornice device as recited in claim 17, wherein said crown member further comprises a fascia board.

27. A cornice device as recited in claim 26, wherein said crown member further comprises a roof nailer member attached to said fascia board of said crown member.

28. A cornice device for use with building structures having an outer wall, comprising:

(a) a crown member having a first end and a second end, said first end being adapted to attach to the roof portion of the building structure, said crown member having a decorative multisurfaced configuration;

(b) a water discharge assembly spaced apart from the outer wall of the building structure, said water discharge assembly being configured to discharge water from the cornice device so as to prevent damage to or contact with the outer wall of the building structure; and (c) a connector member comprising a first leg and a second leg, said first leg being configured to cooperate with said second end of said crown member remote from the outer wall of the building structure, said second leg being configured to attach to the outer wall, said second leg extending outwardly from the outer wall.

29. A cornice device as recited in claim 28, wherein said second end of said crown member has a locking groove formed therein.

30. A cornice device as recited in claim 28, wherein said water discharge assembly has a spaced apart relationship with the outer wall of the building structure.

31. A cornice device as recited in claim 29, wherein said water discharge assembly comprises a drip lip.

32. A cornice device as recited in claim 31, wherein said water discharge assembly further comprises a water trough formed by the interior surface of said second end of said crown member and said first leg of said connector member.

33. A cornice device as recited in claim 32, wherein said water discharge assembly comprises a plurality of apertures formed in at least one of said connector member and said crown member, said plurality of apertures being configured to allow water to pass therethrough.

34. A cornice device as recited in claim 31, wherein said drip lip is formed in said connector member.

35. A cornice device as recited in claim 31, wherein said drip lip is formed by said second end of said crown member and said first leg of said connector member.

36. A cornice device as recited in claim 31, wherein said drip lip has a plurality of apertures formed therein to allow water to pass therethrough so as to be discharged from said drip lip without contacting the outer wall of the building structure.

37. A cornice device as recited in claim 33, wherein said plurality of apertures also allow air to pass into an interior space of the building structure.

38. A cornice device as recited in claim 28, wherein said crown member further comprises an integrally formed fascia board.

39. A cornice device as recited in claim 38, wherein said crown member further comprises a roof nailer member communicating with said fascia board, said roof nailer member being configured for attachment to a roof of the building structure.

40. A cornice device as recited in claim 28, wherein said crown member and said connector member are configured to flex during installation.

* * * * *